United States Patent [19]

Evans et al.

[11] Patent Number: 4,478,521

[45] Date of Patent: Oct. 23, 1984

[54] DIGITAL TIME METER

[75] Inventors: Dennis W. Evans, Royal Oak; John F. Ellis, Madison Heights, both of Mich.

[73] Assignee: Perfection Electronic Products Corp., Royal Oak, Mich.

[21] Appl. No.: 319,697

[22] Filed: Nov. 9, 1981

[51] Int. Cl.[3] ..... G04F 8/00

[52] U.S. Cl. ..... 368/8; 368/9; 340/52 R; 340/52 F

[58] Field of Search ..... 368/1, 6–10; 340/52 R, 52 F, 52 D

[56] References Cited

U.S. PATENT DOCUMENTS

| | | | |
|---|---|---|---|
| 3,965,669 | 6/1976 | Larson et al. | 368/9 |
| 4,022,017 | 5/1977 | Aoki et al. | 368/6 |
| 4,340,945 | 7/1982 | Gothe | 368/52 F |

FOREIGN PATENT DOCUMENTS

| | | | |
|---|---|---|---|
| 5101890 | 8/1980 | Japan | 368/6 |

*Primary Examiner*—Bernard Roskoski

*Attorney, Agent, or Firm*—Harness, Dickey & Pierce

[57] ABSTRACT

A digital time meter for use in a vehicle or other motorized equipment for sensing, accumulating, displaying and retaining the total time a monitored signal from the vehicle or the equipment is present employs a crystal oscillator time base to time the monitored signal. The meter uses integrated circuits to count pulses emanating from the time base in order to accumulate the total time the monitored signal is present. These integrated circuits also have decoder/driver circuitry with multiplexing capabilities to operate a digital display. Power to operate the meter is obtained from the monitored signal when said signal is present, and a replaceable internal battery when said signal is absent. The battery can be replaced without affecting the timing and accumulating functions of the meter provided the monitored signal is present. When the monitored signal is absent, a display switching circuit disables the display to prolong battery life. The meter can retain the accumulated time for several years on battery power alone. The digital display can be detached from the meter to prevent unauthorized reading of the display and to protect the display from physical damage.

10 Claims, 8 Drawing Figures

Advance SW1
1/36 Hz
IC4
MM74C926
Clock-12
IC5
CD4081
IC2
CD4020
Reset-11
10-Clock
Carry
IC3
MM74C926
Clock-12
R1-R7
R8-R14
DD2
DD1
LSD
MSD
RCP1
PLG1
Q1
Q2
Q3
Q4
Q5
Q6
Q7
60Hz
IC1
MM5369
R16
X1
C2
C3
Reset SW2
D4
R18
B1
D3
R17
V1 Reg.
C1
D2
Z1
D1
R15
MOV1
Y1
Y2

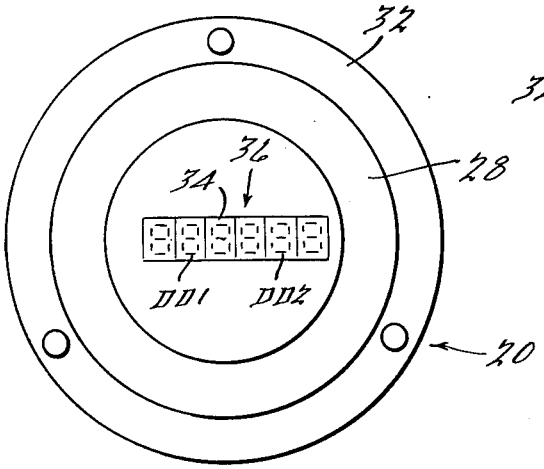
FIG. 5.
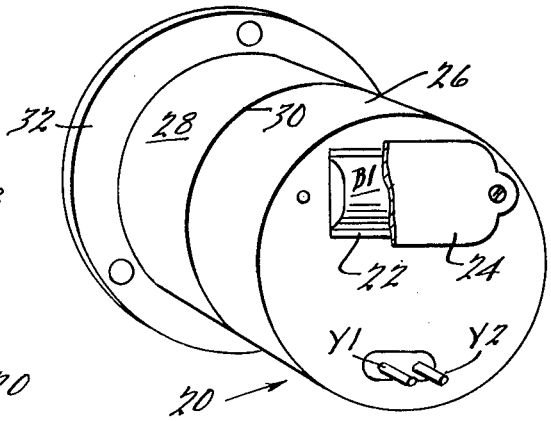
FIG. 4.
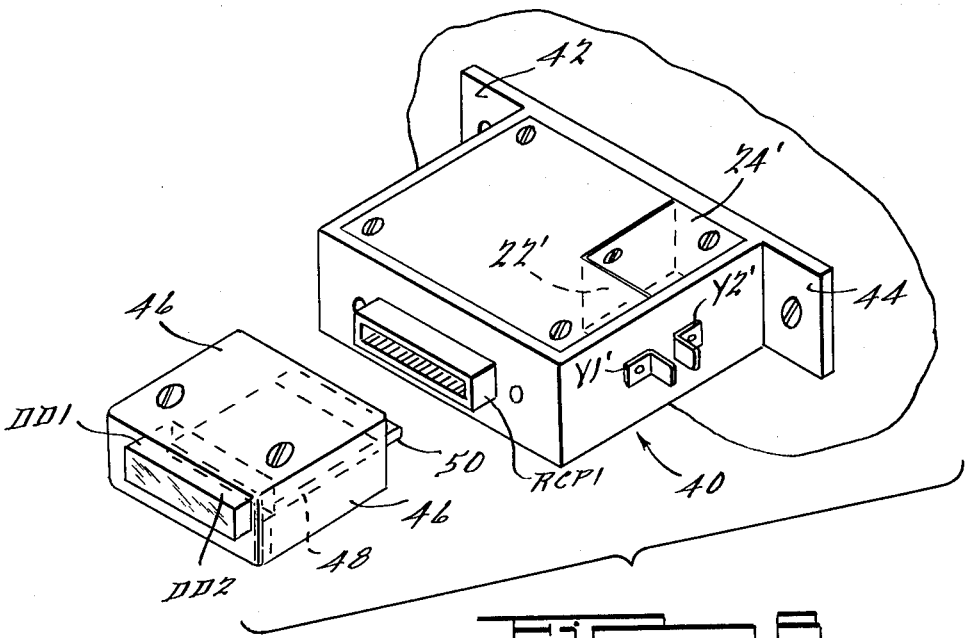
FIG. 3.
FIG. 6.
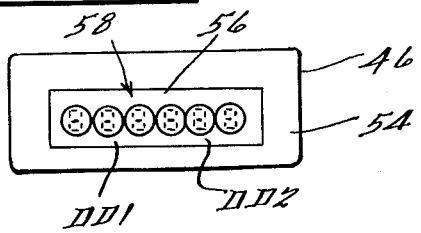
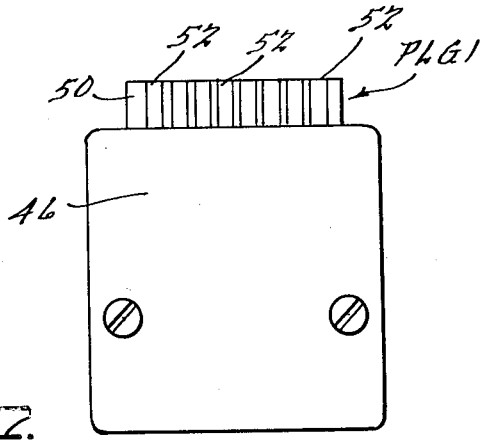
FIG. 7.

DIGITAL TIME METER

BACKGROUND AND SUMMARY OF THE INVENTION

This invention relates to the field of electronic timers, and more particularly to the field of electronic elapsed time meters for vehicles and other motorized equipment and analogous or equivalent applications requiring maintenance at periodic intervals.

At present, there is a need in commerce and industry for a compact, inexpensive and accurate, electronic digital time meter for measuring, over a period of months or years and through intermittent power outages on a motorized vehicle or piece of equipment, the total time a monitored signal is present. For example, on a forklift truck in a warehouse, or a motor-generator set in a factory, it would be useful to monitor the total time the vehicle or equipment is running, or performing some particular function.

Persons needing such a time meter include maintenance personnel who perform preventive maintenance on such vehicles or equipment at regularly scheduled intervals determined by actual time the vehicle or equipment has been in use.

Those who might well desire such a timer include supervisory personnel who wish to record the amount of time drivers of vehicles are performing a particular task, industrial engineers studying and measuring the efficiencies of various man-vehicle combinations, and maintenance personnel troubleshooting problems with the vehicles, motor-generator sets, or other motorized equipment that operates intermittently.

For certain applications of such time meters, it would be desirable or even necessary to make the digitial display of the meter detachable, that is, easily and manually removable. Removing the display would prevent unauthorized reading of the meter and protect the display from physical damage. Also, the total cost of several meters used as a set could be reduced by such a feature since one display could be employed to read all of the meters in the set.

In other applications, it may be desirable or required to have a meter whose internal battery could be replaced without interrupting the timing or totalizing functions of the meter.

Certain applications of such a meter may require a means for comparing the total elapsed time measured by the meter against a preset value and sounding an alarm or disabling a function on the vehicle or equipment when the elapsed time equals or exceeds the preset value. This feature could be used to assure that appropriate action is taken with respect to the vehicle or equipment being monitored at prescribed intervals.

Traditionally, electronic digital timers have not been used to measure intermittent signals over a period of several months or years. One of the primary reasons for this is that an unacceptably large internal battery would have been required to operate a traditional timing circuit made of discrete components over such an extended period. Also, the large number of discrete components traditionally required in such an electronic timer would have made it prohibitively expensive and large in comparison to an electro-mechanical timer or a timer employing a coulometric electrolytic cell for integration elapsed time. Advancements in integrated circuit technology in the past decade have reduced the size, power comsumption and cost of timing circuits and digital display circuits and digital display circuits to the point where electronic digital time meters are now practical and cost-competitive, providing inventors with the incentive to turn their attention to this area.

The basic object of this invention is to provide a digital time meter adapted for measuring and time-totalizing an intermittent electrically monitorable condition or signal on motorized commercial or industrial equipment over a period of several months or years without changing the battery within the meter.

Another object of this invention is to provide a digital time meter adapted for fulfilling the basic object of this invention with excellent accuracy.

Still another object of this invention is to provide a digital time meter with a removable display.

Still another object of this invention is to provide a digital time meter whose battery can be replaced without resetting or interrupting the timing function of the meter.

Yet another object of this invention is to provide a digital time meter having a means for providing an alarm or signaling external equipment when the accumulated time on the meter equals or exceeds a preset value stored within the meter.

Other objects, features and advantages of the present invention will become apparent from the subsequent description and the appended claims, taken in conjunction with the accompanying drawings.

BRIEF DESCRIPTION OF THE DRAWINGS

FIG. 3 is a block diagram of a digital time meter having, among other things, a maintenance timer with a selectable preset value feature and two-stage indicator-/alarm;

FIG. 4 is a perspective view of a housing of a digital time meter illustrating a compartment for a replaceable battery;

FIG. 5 is a front view of the housing in FIG. 4 illustrating a digital display;

FIG. 6 is a perspective view of a housing for a digital time meter and a case for a detachable digital display illustrating the case detached from the housing;

FIG. 7 is a top view of the digital display case in FIG. 6 illustrating a set of spaced contact strips of a printed circuit board plug; and FIG. 8 is a front view of the detachable digital display and case in FIG. 6.

DESCRIPTION OF THE PREFERRED EMBODIMENTS

Figure 1:
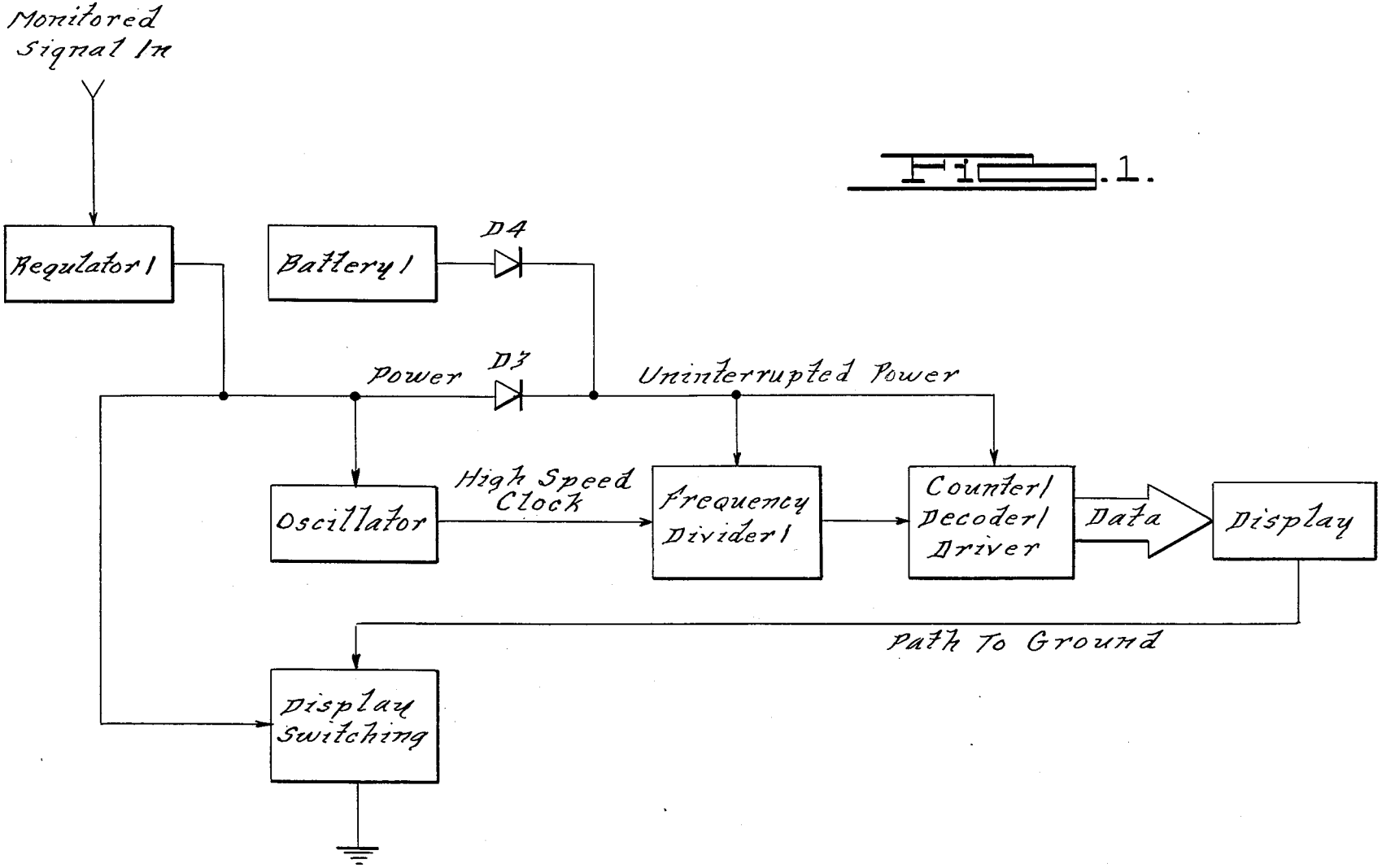
FIG. 1 is a block diagram of a digital time meter having a detachable digital display and replaceable battery.

Referring to FIG. 1 in detail, the block diagram disclosed therein represents the major circuits and/or components of a digital meter that is adapted to monitor an external electric signal from a motorized piece of equipment, such as a forklift truck or motor-generator set. The monitored signal may be continuous or intermittent. Such a meter times the monitored signal, accumulates the total elapsed time that the signal is present, and displays the total time on a digital display. The block diagram in FIG. 1 includes the following blocks: (1) a voltage regulator block, Regulator 1, which receives the monitored signal, and employs it as a source of power, conditioning it to produce a regulated supply of DC voltage which operates the meter; (2) a crystal oscillator block, Oscillator, which is used to produce a high frequency time standard signal, that is, a high speed clock signal; (3) a frequency divider, Frequency Divider 1, which transforms the high frequency time standard signal from the Oscillator into a periodic unit time signal that is used to drive counters within the meter; (4) an integrated circuit block, called the Counter Decoder/Driver, for cumulatively counting the periods of the unit time signal, decoding the accumulated period count to facilitate its transmission and display, and generated driving signals adapted for automatically operating a digital display; (5) a digital display block, Display, that receives the driving signals from the Counter/Decoder/Driver and displays the accumulated period count encoded therein, which represents the total elapsed time that the monitored signal has been present; (6) a battery block, Battery 1, which represents an internal power source such as a battery, for supplying power to the Counter/Decoder/Driver to retain the accumulated period count during loss of power from Regulator 1; and (7) a display switching block, Display Switching, for turning off the Display when the monitored signal is absent to reduce the power drain imposed on Battery 1.

When these blocks are connected as shown in FIG. 1, a functional digital time meter results. When the monitored signal is absent, Regulator 1 of course produces no power, which turns off the Oscillator and Display Switching blocks. When the Oscillator is off, the accumulated period count cannot be incremented since there is no clock signal present with which to pulse the counters in the Counter/Decoder/Driver. When the Display Switching block is off, the path to ground for the current operation the Display is opened, thereby disabling the Display in an off state, which conserves the power of Battery 1.

Diode D3, as shown in FIG. 1, prevents power from Battery 1 from turning on the Oscillator or Display Switching blocks when the monitored signal is absent. Because there are other conventional ways in which a block of circuitry, such as the Oscillator, can be made nonresponsive to power from a particular source, such as Battery 1, the arrangement of diode D3 within the block diagram of FIG. 1 is intended merely to illustrate that in the digital time meter herein disclosed, the internal power source of the meter, Battery 1, is not to turn on the Oscillator or Display when the monitored signal is absent.

Diode D4, shown in FIG. 1, or some equivalent current-blocking circuit, is necessary if the internal power source represented by Battery 1 cannot stand sustained charging by Regulator 1 when the monitored signal is present. If Battery 1 is comprised of a rechargeable battery and associated circuitry, for example, diode D4 could be eliminated.

Because Battery 1 feeds its power to Frequency Divider 1 and Counter/Decoder/Driver, these two blocks have an uninterrupted source of power. Thus, when the monitored signal is lost, Frequency Divider 1 and the counter portion of Counter/Decoder Driver simply maintain their present state until the monitored signal is restored. In this manner, the accumulated period count is retained when the monitored signal is absent.

Frequency Divider 1 could be eliminated if the high frequency time standard signal were suitable for driving the clock input of the counter in the Counter/-Decoder/Driver block directly. This of course depends on the use to which the digital time meter is put, and the output frequency of the Oscillator block.

Frequency Divider 1 would typically be comprised of a digital counter as is discussed in detail later with respect to FIG. 2 and integrated circuit IC2 therein. If Frequency Divider 1 is a counter, the over-all timing accuracy of the digital meter is improved by powering Frequency Divider 1 with uninterrupted power, since the count therein is not lost each time the monitored signal is lost. It is understood, though, that Frequency Divider 1 could be powered directly from Regulator 1 with the resultant reduction in timing accuracy in certain applications of the meter where great accuracy is not crucial.

Other features add advantages of the digital time meter shown in block diagram form in FIG. 1 will become apparent in the explanation of FIG. 2 directly below.

Figure 2:
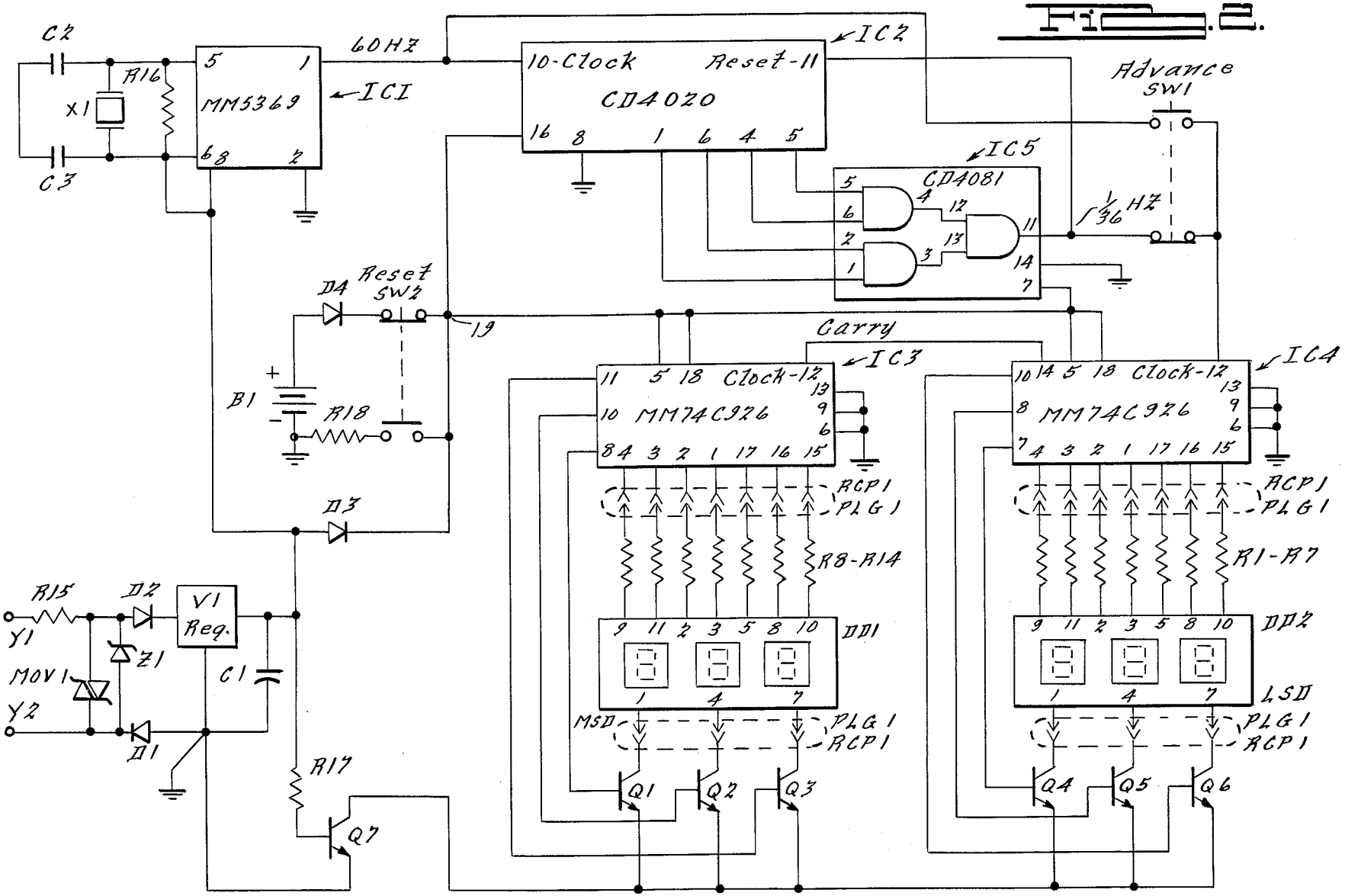
FIG. 2 is an electronic circuit diagram of a digital time meter implementing the block diagram shown in FIG. 1.
Figure 2:
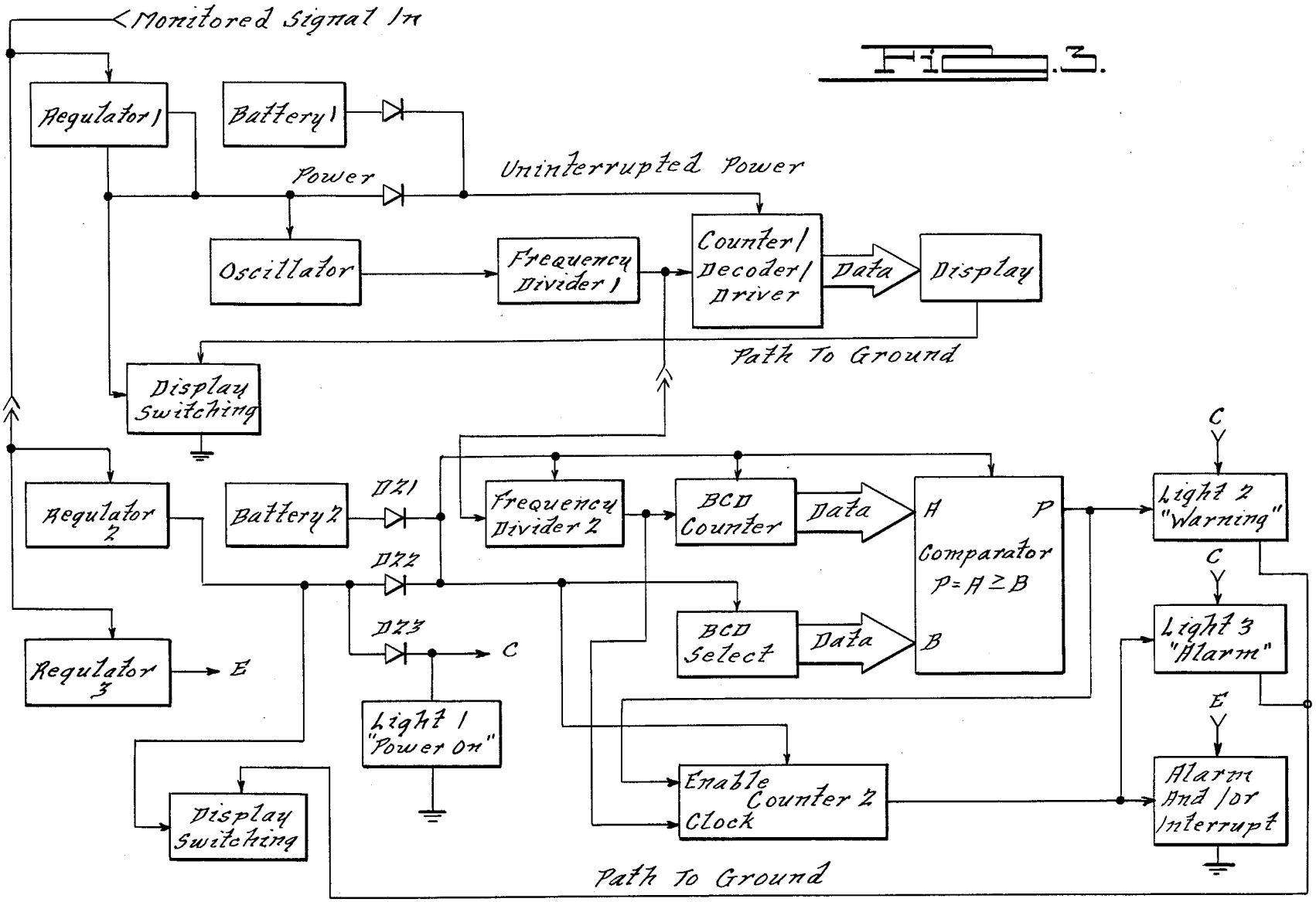

Referring to FIG. 2 in detail, the digital time meter disclosed therein represents the preferred embodiment of the meter shown in block diagram form in FIG. 1. The meter disclosed in FIG. 2 is set up to display the total elapsed time the monitored signal has been present in tenths of an hour, up to a maximum of 99,999.9 hours. Of course, other timing intervals and a different number of total digits could be chosen for display, without departing from the spirit of the invention, by making minor modifications to the circuit shown. The total time is displayed on a digital LED display, comprised of two display portions, DD1 and DD2, of three digits each.

As shown in FIG. 2, the monitored signal is received by the meter at terminals Y1 and Y2. Voltage regulator V1 employs the monitored signal as a source of power to produce a regulated supply of DC voltage, which is used to operate the meter, including the digital display portions DD1 and DD2, as well as the four integrated circuit chips IC1, IC2, IC3 and IC4.

When the monitored signal is absent, battery B1 is used to provide power to integrated circuits IC2, IC3, and IC4 to retain the accumulated time values stored therein. The accumulated time values are stored as counts in binary and BCD counters, as will be explained in detail later. To conserve battery power and thus promote longer battery life, the digital display is switched off via transistor Q7 when the monitored signal is absent.

The digital time meter times the monitored signal by allowing a crystal quartz oscillator time base built around IC1 to run only when the monitored signal is present, thus producing a sixty hertz output signal to drive the counters in IC2, IC3 and IC4 in the following manner.

The sixty hertz signal is fed into a frequency divider circuit built around IC2, which reduces the sixty hertz signal down to a much slower unit time signal of one pulse every thirty-six seconds, that is, one pulse every one-hundredth of an hour.

The unit time signal is fed into the clock input of IC4. IC4 is an integrated circuit chip containing a four decade BCD counter, decoding circuits, and digital display driving circuits. IC3 is identical to IC4. The counters in IC3 are cascaded to the counters in IC4 in order to increase the counting capacity of the meter to eight BCD digits. Since the digital display only has six digits or decades, the least significant decade in IC4 and the most significant decade in IC3 are not presented on the digital display.

The counters of IC4 and IC3 count the number of pulses or periods of the unit time signal. The accumulated count thus represents the total time the monitored signal has been present, assuming of course that the counters have not been manually reset or advanced.

As shown in FIG. 2, the Advance switch SW1 when actuated will advance the total time accumulated on the meter by incrementing the counters in IC4 at a rate of sixty hertz. The Reset switch SW2 when actuated will reset the counters of IC2, IC3 and IC4 to zero.

Armed with this brief overview of the digital time meter shown in FIG. 2, individual circuits and their features disclosed therein may now be appreciated.

The monitored signal received at terminals Y1 and Y2 must flow through resistor R15 and diodes D1 and D2. Resistor R15 is sized to limit the voltage presented to the voltage regulator V1 to acceptable levels. Diodes D1 and D2 serve to protect the voltage regulator V1 from damage due to polarity reversal of the monitored signal. On the input side of the voltage regulator, zener diode Z1 and varistor MOV1 serves to shunt high frequency transients riding on the monitored signal harmlessly to ground, while capacitor C5 serves the same purpose on the output side of the voltage regulator.

In the preferred embodiment shown in FIG. 1, battery B1 is a commercially available, four volt mercury battery having a shelf life of seven years. Diode D4, which is connected in series with the battery B1, prevents the battery from being charged by the voltage regulator V1 when the monitored signal is present. It is to be understood that other conventional long-lived batteries could be used in place of the aforementioned battery. Similarly, different voltage levels could be employed. Also, an alternate source of internal power could be used, such as a conventional rechargeable battery circuit.

Diode D3, connected as shown in FIG. 1, helps the digital time meter conserve battery power when the monitored signal is absent by preventing battery power from feeding back to turn on transistor Q7. When transistor Q7 is off, the digital display portions DD1 and DD2 are necessarily off, since transistor Q7 provides the only path to ground for the current running through the display portions. Also diode D3 prevents battery power from reaching the oscillator circuit built around IC1, which assures that the sixty hertz output from IC1 is off when the monitored signal is absent. With the sixty hertz output off, the counters in IC2, IC3 and IC4 are not incremented.

When the monitored signal is off, battery B1 supplies power to the integrated circuit chips IC2, IC3 and IC4 to maintain the counts contained therein. Because IC2, IC3, IC4 and IC5 are CMOS chips, the power drain on the battery is extremely low, approximately twenty-five microamps. With this extremely light current drain, the battery B1 can maintain the counts within IC2, IC3 and IC4 for two or three years, perhaps even longer.

The integrated circuit IC1 is a CMOS integrated circuit with seventeen binary divider stages that can be used to generate a precise sixty hertz output from commonly available high frequency quartz crystals, such a 3,579,545 Hz quartz crystal X1, when interconnected to the resistor capacitor network comprised of resistor R16 and capacitors C2 and C3 shown in FIG. 2. The preferred embodiment uses as IC1 a National Semiconductor integrated circuit chip Catalog Number MM5369N.

If an application for the digital time meter requires that the oscillator circuit have an output frequency other than 60 Hz, this can easily be arranged by using a quartz crystal of a different frequency or changing the number of binary divider stages used.

The integrated circuit IC2 is a CMOS fourteen stage ripple carry binary counter which is incremented one count by each clock pulse. The stages are reset to the zero state by a logical "1" at the reset input, independent of the clock input state. The preferred embodiment uses as IC2 a National Semiconductor integrated circuit chip Catalog Number CD4020BM.

As shown in FIG. 2, integrated circuit IC2 and a four input AND gate, formed from a combination of two input AND gates on IC5, comprise a frequency divider for reducing the sixty hertz input from IC1 down to a unit time signal of one pulse every thirty-six seconds, which is one pulse every one-hundredth of an hour. The preferred embodiment uses as IC5 a National Semiconductor CMOS integrated circuit chip Catalog Number CD4081.

Since there are 2,160 pulses at sixty hertz in a thirty-six second interval, obtaining the desired unit time signal is accomplished by decoding the binary outputs of IC2 to determine when a count of 2,160 has been reached on the counter in IC2. Pins 1, 4, 5 and 6 of IC2 are outputs of the internal binary counter having a weighted value of 2048, 32,16 and 64 respectively. These values summed equal 2,160. The four inputs of the aforementioned AND gate are coupled to these pins of IC2, so when all four pins are at a logical "1", that is high, the AND gate produces an output. The output pulse produced travels through the normally closed contact of SW1 to the clock input of IC4, thereby incrementing the counters of IC4, and to the reset pin of IC2, thereby resetting the counters of IC2. Once IC2 is reset, the output pulse of the AND gate disappears, and IC2 can immediately begin counting to 2,160 again.

By using a different set of outputs from the binary stages of IC2 in conjunction with a combination of AND gates, virtually any desired frequency division may be obtained. Similarly, the circuitry associated with IC2 is intended to be merely representative of any conventional digital frequency divider constructed from integrated or discrete components.

Integrated circuits IC2 and IC4 shown in FIG. 2 are each a National Semiconductor CMOS integrated circuit chip Catalog Number MM74C926, which contains a four decade BCD counter, multiplexed seven segment output drivers, and the necessary decoder circuitry to convert BCD values from the counter into seven segment display codes at the appropriate times.

The clock input of IC4 is connected to the output of the aforementioned AND gate, and thus four digit BCD counter within IC4 counts the pulses at one-hundredth of an hour intervals emanating from the AND gate. The clock input of IC3 is driven by the carryout pin of IC4, thereby cascading the counters of IC3 and IC4.

Neither the least significant BCD digit of the counter in IC4, the one-hundredth of an hour digit, nor the most significant digit of IC3, the hundred-thousands of hours digit, are displayed on the digital display since the display only has six digits.

Integrated circuits IC3 and IC4 each contain a multiplexing circuit having four multiplexing outputs, on pins 7, 8, 10 and 11, one for each internal BCD digit.

Each multiplexing circuit has its own freerunning oscillator, and so requires no external clock. Pins 1, 2, 3, 4, 15, 16 and 17 of IC3 and IC4 are the outputs of the NPN output sourcing drivers for a seven segment display.

While the circuitry associated with IC3 and IC4 is the preferred embodiment for a digital counter/decoder/-driver, it is understood that other combinations of digital circuitry performing an equivalent function could also be used in the present invention.

Digital display portions DD1 and DD2 are each a Hewlett Packard three digit, solid state, seven segment, monolithic numeric indicator Catalog Number 5082-7433, which is adapted for operation by standard seven segment decoder/driver circuit with multiplexing capabilities. Resistors R1 through R7 serve to limit the individual segment currents drawn by DD1 to acceptable values. Resistors R8 through R14 perform the same segment current limiting function for DD2.

As shown in FIG. 2, transistors Q1, Q2 and Q3 receive the multiplexer strobe or timing signals from IC3 in order to selectively or sequentially enable the digits of display portion DD1 in synchronization with the seven segment date flowing from IC3. Transistors Q4, Q5 and Q6 perform the same function for display portion DD2, by receiving the multiplexer strobe signals from IC4.

Other conventional components, such as liquid crystal displays, could be used in place of DD1 and DD2 to achieve equivalent display results.

As shown in FIG. 2, one side of a normally open contact of the Advance Switch SW1 is connected to the 60 Hz output of IC1, while the other side of said contact is connected to the clock input of IC4. One side of a normally closed contact of SW1 is connected to the AND gate output, while the other side is connected to the clock input of IC4. Accordingly, when the Advance Switch SW1 is actuated, the counter in IC4 will be incremented at sixty hertz. The normally closed contact of SW1, which is open when SW1 is actuated, prevents the 60 Hz signal from feeding back into IC5.

As shown in FIG. 2, a normally closed contact of the Reset Switch SW2 is serially disposed between diode D4 and node 19. A normally open contact of SW2 is disposed between node 19 and resistor R18, and the other end of resistor R18 is connected to ground. Thus, when SW2 is actuated, power to IC2, IC3, IC4 and IC5 from Battery B1 is interrupted, and the counters in IC2, IC3 and IC4 are reset to zero, provided no power is being supplied to them by the voltage regulator V1. When SW2 is actuated, resistor R18 helps bleed off any residual charge to hasten the reset of the counters.

It should be appreciated that there are other well-known and conventional ways to reset and advance counters, which would produce equivalent results if employed in place of the Advance and Reset circuitry shown in FIG. 2.

The digital time meter disclosed in FIG. 2 has excellent timing accuracy, since it employs a very stable high frequency crystal oscillator circuit as a source of timing. Timing accuracy is maintained in the digital time meter even in the face of an intermittent monitored signal since IC2 is kept powered by the battery B1 when the monitored signal is absent. Thus, timing errors are introduced into the time meter only through: a few millisecond delay caused by charging of capacitor C1 each time the monitored signal is turned on; the inherent, but very minor, fluctuations of the high frequency crystal oscillator circuit; and the miniscule start-up delay of the crystal oscillator circuit built around IC1. In most common applications of the digital time meter, timing accuracy of one-hundredth of one percent can be achieved.

In a broad sense, the digital display shown in FIG. 2 can be said to be comprised of resistors R1 through R14, transistors Q1 through Q6, digital display portions DD1 and DD2, and connector receptacle RCP1 and complementary plug PLG1. The purpose of the receptable RCP1 and plug PLG1 is to make the digital display portions DD1 and DD2 detachable. Such a digital display obviously has at least two sections: a base section permanently attached to the rest of the digital time meter and coupled to the integrated circuit chips IC3 and IC4 and a digital display section coupled to and detachable from the base section.

The base section is comprised of transistors Q1 through Q6 and the female connector receptacle RCP1. The display section is comprised of digital display portions DD1 and DD2, resistors R1 through R14, and mating plug PLG1. The receptacle RCP1 and the plug PLG1 could easily be omitted to form a digital time meter having a digital display that is nondetachable.

FIGS. 4 and 5 show an all plastic, basically cylindrical housing 20 for a digital time meter having a circuit very similar to that shown in FIG. 2, except that the digital display is nonremovable. The rear of the housing has a compartment 22 with cover 24 for a conventional four volt mercury battery B1. The battery B1 is replaceable, since electrical contact with the battery is made in a conventional springloaded manner, such a pair of curved leaf-spring contacts positioned at opposite ends of the battery compartment. Battery compartment 22' and cover 24' serve the same purpose for the digital time meter shown in FIG. 6.

When the aforementioned technique for rendering the battery replaceable is employed in a meter having a circuit identical or similar to that shown in FIG. 2, the battery can be replaced whenever the monitored signal is present without affecting the timing, accumulating, or display functions of the meter, since the voltage regulator V1 supplies all the power needs of the meter when the monitored signal is present.

The housing 20 shown in FIGS. 4 and 5 is comprised of a rear cylindrical section 26 and a frong cylindrical section 28 telescopically joined near the middle 30 of the housing. The front section has an annular mounting flange 32 and a plastic transparent window 34 providing visual access to the digital display 26 positioned directly behind the window. Terminals Y1 and Y2, found on the rear of housing 20, are shown as male pin connectors and are adapted to receive a female plug coupled to the monitored signal. Other conventional termination devices could be used in place of the pin connectors, such as the spade terminals Y1' and Y2' shown in FIG. 5. As shown in FIG. 5, the digital display is comprised of two display portions DD1 and DD2 of three digits each, disposed adjacent to one another to obtain a display of six contiguous digits.

One possible way to package a digital time meter having a detachable display and circuit identical to that in FIG. 2 is shown in FIG. 6. A rectangular housing 40 with mounting flanges 42 and 44 houses all of the digital meter except the detachable display section of the digital display, which is contained in a case 46. The digital display portions DD1 and DD2 are mounted on a printed circuit board 48 that is disposed primarily within the case 46. Resistors R1 through R14, not shown, are also mounted on the printed circuit board 48.

The region 50 of the printed circuit board 48 opposite the display comprises the plug PLG1 and is provided with spaced edge connector contact strips 52, as shown in FIG. 8. The region 50 is complementary to and adapted to be plugged into printed circuit board connector receptable RCP1 protruding from the housing 40, as shown in FIG. 6.

As shown in FIG. 7, the front 54 of the case 46 has a plastic transparent window 56 to provide visual access to the digital display 58 positioned behind the window. As in FIG. 5, the display is comprised of two display portions DD1 and DD2.

Turning to the block diagram shown in FIG. 3, the upper half of FIG. 3 shows the basic digital time meter of FIG. 1. The digital time meter shown in FIG. 3 incorporates all of the concepts of the meter in FIG. 1, and in addition has a two-stage maintenance timer shown in the lower half of FIG. 3. This timer is connected to the basic meter in two places. First, the monitored signal feeding into Regulator 1 is connected to Regulator 2 and Regulator 3 to provide a source of power for these regulators, which produce a regulated DC voltage supply used to operate the maintenance timer. Second, the output of Frequency Divider 1, which corresponds to the unit time signal referred to in FIG. 2, is connected as an input to Frequency Divider 2, to clock the maintenance timer.

The purpose of the two-stage maintenance timer shown in FIG. 3 is to provide a first indication when the total elapsed time has reached a selected preset value, and a second indication when it has reached a second value a fixed number of time units above the preset value. When the elapsed time, accumulated as a count in BCD Counter, first equals the preset value, Light 2, a warning light, is turned on. After the monitored signal is present for an additional fixed length of time beyond preset value, corresponding to the fixed count of Counter 2, Light 3 and Alarm And/Or Interrupt turns on, providing a second stage of elapsed time indication.

Regulator 2 and Battery 2 perform the same function for the maintenance timer as Regulator 1 and Battery 1 do for the basic digital time meter shown in the upper half of FIG. 3. Regulator 2 also provides regulated DC power through diode D23 to operate Light 1, the "power on" light, Light 2, the "warning" light, and Light 3, the "alarm" light.

Regulator 3 provides DC power to operate the Alarm And/Or Interrupt for those applications where the alarm or interrupt device requires a higher voltage or more power than could be supplied by Regulator 2. The Alarm is a sound-producing device such as a horn or buzzer. The Interrupt is an output device typically used in interfaces such as a relay, triac, or photo-isolated driver transistor.

Frequency Divider 2 reduces the frequency of the periodic time signal received from Frequency Divider 1 down to the desired frequency rate corresponding to the units of time employed in the maintenance timer. For instance, if the output of Frequency Divider 1 were one pulse/one-tenth hour, and one pulse/hour was the unit of time to be used within the maintenance timer, Frequency Divider 2 would be selected to be a 10 to 1 frequency divider. The output of Frequency Divider 2 is used as a clock signal to increment BCD Counter and Counter 2, as shown in FIG. 3.

Frequency Divider 2 may be a digital counter circuit, such as binary stage counter of IC2 in FIG. 2 described earlier or a simple BCD counter that resets itself after the desired count has been reached.

The BCD Counter may be any conventional digital counter circuit capable of outputting the accumulated count contained therein in a BCD format. The optimal digit capacity of the counter is dictated by the particular application in which the maintenance timer is to be used.

The BCD Select block shown in FIG. 3 represents any conventional device or circuit, for manually or electronically selecting a preset numerical value, which can encode the selected value in BCD format for output to a comparator circuit. A rotary thumbwheel switch having a common terminal and four BCD output terminals for each decade, for example, is such a device. The number of digits in the BCD Select should optimally equal the number of digits in the BCD Counter.

The Comparator in FIG. 3 is comprised of any conventional digital comparator which has the ability to provide an output when the BCD value of one of its two BCD inputs equals or exceeds the BCD value of the other input. The output of the BCD Counter and the output of the BCD Select are fed into the inputs A and B of the Comparator. When the value within the BCD Counter equals or exceeds the BCD Select, the Comparator output P turns on.

Counter 2 is a digital counter provided with a clock input, an enable input, and an output. Pulses arriving at the clock input cause the count within Counter 2 to increment, but only when a signal is present at the enable input.

When the Comparator output turns on, it enables Counter 2, as shown in FIG. 3. Counter 2 then begins counting the clock pulses it receives from Frequency Divider 2, which correspond to the amount of time the monitored signal is present. After a predetermined number of counts have been received and counted by Counter 2, the output of Counter 2 turns on, which turns on Light 3, the "Alarm" light, and the Alarm And/Or Interrupt as shown in FIG. 3.

The Light Switching block in the maintenance timer is used to open up the path to ground of Light 2 and Light 3, whereby eliminating virtually all leakage current through Light 2 and Light 3 when the monitored signal is absent. The Light Switching block may consist of a switching transistor arranged similarly to transistor Q7 in FIG. 2.

The maintenance timer shown in FIG. 3 may be constructed as an option which can be added on to the basic digital time meter at will, especially since only two signals and a ground need be connected between it and the basic meter. For example, the maintenance timer could be constructed on a PC board which simply plugs into an empty slot and connector within a housing similar to the housing 20 shown in FIG. 4 or the housing 40 shown in FIG. 6.

The maintenance timer shown in FIG. 3 block diagram may be simplified in many applications by eliminating certain blocks shown therein. First, Regulators 2 and 3, Battery 2, and diodes D21, D22 and D23 may be eliminated by powering all blocks presently powered via Regulators 2 and 3 from Regulator 1 and Battery 1. Second, the Light Switching block may be eliminated by appropriately sizing the components in output sections of the Comparator and Counter 2.

Third, Lights 2 and 3 and the Alarm And/Or Interrupt can be simplified by making them two-wire devices. Such a change is feasible provided the appropriate components in the maintenance timer are sized to safely handle the voltage and current which these devices draw.

In certain applications, it is contemplated that some functions of the maintenance timer presently shown in FIG. 3 will be omitted. For example, if a one-stage maintenance timer is all that is required for a particular application, Counter 2, Light 3, and Alarm Interrupt may be omitted. Note that such a maintenance timer could alternatively employ an Alarm And/Or Interrupt in place of, or in parallel with, Light 2.

Frequency Divider 2 can be eliminated when the output of Frequency Divider 1 happens to be the desired clock frequency for the maintenance timer.

Light 1, the "power on" light, is included in FIG. 3 as a convenience for maintenance personnel who wish to verify the maintenance timer is receiving power from the monitored signal. It can be eliminated without affecting the functions of the rest of the maintenance timer.

All of the aforementioned simplifications could be made simultaneously if desired, which would result in a simple maintenance timer having only a BCD Counter, BCD Select, Comparator, and an output indicating device, such as alarm, interrupt, or light.

For specific applications where a fixed length of time could be employed instead of a selectable length of time, even the BCD Select and Comparator blocks could be eliminated, leaving only the BCD counter, which then could be any type of digital counter having at least one output, and the output indicating device, such as an alarm, relay, or light.

It is contemplated that, although not shown in FIG. 3, the maintenance timer includes some conventional means by which the accumulated count in the BCD Counter and Counter 2 may be reset to zero as needed. Such a reset means, for example, may be similar to the Reset switch SW2 and its associated circuitry shown in FIG. 2.

Similarly, the basic digital time meter shown in FIG. 1 is understood to include, if required by the application, conventional means by which the counters therein may be reset or advanced as needed. The combination of Advance switch SW1, Reset Switch SW2, and associated circuitry in FIG. 2 provides one example of such means.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. A digital time meter for sensing the presence of and for timing a monitored electrical signal, for accumulating the total time the monitored electrical signal is present, for displaying the total time, and for retaining the total time when the monitored electrical signal is absent, comprising:

crystal oscillator circuit means for producing a periodic unit time signal;

integrated circuit means coupled to the crystal oscillator circuit means for cumulatively counting periods of the unit time signal, decoding the accumulated period count to facilitate transmission and display of said count, and generating driving signals, some encoded with said count;

said oscillator circuit means comprises: a first circuit portion including a crystal oscillator producing a standard time signal that is a multiple frequency of the unit time signal frequency and a second circuit portion coupled to the first circuit portion, including a frequency divider for transforming the standard time signal into the unit time signal, said first circuit portion, coupled to the manual input circuit means to transmit the standard time signal thereto, enabling the manual circuit input means to increment the accumulated period count at the frequency of the standard time signal, thereby facilitating rapid incrementing of the of the accumulated period count;

digital display means coupled to the integrated circuit means for receiving said driving signals from the integrated circuit means and displaying said count encoded therein;

a voltage regulator circuit having an output coupled to the oscillator circuit means and integrated circuit means and an input coupled to a monitored electrical signal, said voltage regulator circuit regulating the monitored electrical signal when present to produce power to operate a digital time meter;

internal power source means coupled to the integrated circuit means and conditioning circuit means for supplying power to the integrated circuit means to retain the accumulated period count during loss of power from the conditioning circuit means; and the oscillator circuit means and integrated circuit means cooperating to increment the accumulated period count only when the monitored electrical signal is present, thereby timing and accumulating the total time the monitored electrical signal is present.

2. A digital time meter as recited in claim 1, further comprising:

display switching means coupled to the display means and conditioning circuit means for enabling the display means when the monitored electrical signal is present and disabling the display means when the monitored electrical signal is absent, thereby reducing the power drain imposed on the internal power source means by the integrated circuit means when the monitored electrical signal is absent.

3. A digital time meter as recited in claim 1, further comprising:

manual input circuit means coupled to the integrated circuit means for resetting and incrementing the accumulated period count, having a first manually operable switch for resetting said count, and a second manually operable switch for incrementing said count.

4. A digital time meter as recited in claim 1, wherein the internal power source means comprises:

a battery, and a diode coupled in series with the battery to prevent the battery from being charged by the conditioning circuit means.

5. A digital time meter as recited in claim 4, further comprising:

battery holder means for detachably and securely retaining the battery in place when the battery is coupled to the digital time meter, said battery holder means facilitating removal and replacement of the battery while the conditioning circuit means is supplying power to the digital time meter without interrupting the sensing, timing, and cumulating of the total time the monitored signal is present.

6. A digital time meter as recited in claim 1, in which the digital display means comprises:

a base section permanently attached to the digital time meter and coupled to the integrated circuit means; and a digital display section coupled to and detachable from the base section, the digital display section being detachable from and reattachable to the base section without interrupting the sensing, timing and accumulating functions of the digital time meter, thereby facilitating protection of the digital display section from physical damage, and thereby adapting the digital display section for use in more than one piece of electronic equipment.

7. A digital time meter as recited in claim 6, wherein:

the digital display section includes a printed circuit board having an edge region provided with spaced edge connector contact strips, and the base section includes a female printed circuit board connector complementary to and coupled to the edge region of the digital display portion disposed therein, thereby providing a detachable connection between the digital display section and base section, rendering the display section manually removable from the digital time meter.

8. A digital time meter as recited in claim 1, further comprising:

a maintenance time circuit means, coupled to the oscillator circuit means, for providing an indication distinct from the digital display means, that the monitored signal has been present for a preselected interval of time whereby an indication is provided that a specified maintenance function is necessary.

9. A digital time meter as recited in claim 1, in which the oscillator circuit means comprises:

a first circuit portion including a crystal oscillator producing a high frequency standard time signal, and a second circuit portion including a frequency divider for transforming the standard time signal into the unit time signal, said second circuit portion coupled to the internal power circuit means to facilitate retaining the state of the frequency divider during loss of power from the conditioning circuit means, thereby helping to maximize the timing accuracy of the digital time meter.

10. A digital time meter, adapted for use in motorized equipment, for accumulating, displaying and retaining the total time a monitored signal from the equipment is present, comprising:

crystal oscillator circuit means for producing a periodic unit time signal;

integrated circuit means coupled to the crystal oscillator circuit means for cumulatively counting periods of the unit time signal, decoding the accumulated period count to facilitate transmission and display of said count, and generating driving signals, some encoded with said count;

digital display means coupled to the integrated circuit means for receiving said driving signals from the integrated circuit means and displaying said count encoded therein;

a voltage regulator circuit having an output coupled to the oscillator circuit means and integrated circuit means and an input coupled to a monitored signal, said voltage regulator circuit regulating the monitored signal when present to produce power to operate a digital time meter;

internal power source means coupled to the integrated circuit means and conditioning circuit means for supplying power to the integrated circuit means to retain the accumulated period count during loss of power from the conditioning circuit means;

display switching means coupled to the display means and conditioning circuit means for enabling the display means when the monitored signal is present and disabling the display means when the monitored signal is absent; and manual input circuit means coupled to the integrated circuit means for resetting and incrementing the accumulated period count, having a first manually operable switch for resetting said count, and a second manually operable switch for incrementing said count, the oscillator circuit means and integrated circuit means cooperating to increment the accumulated period count only when the monitored signal is present, thereby timing and accumulating the total time the monitored signal is present, and a maintenance timer circuit means, coupled to the oscillator circuit means, for providing an indication distinct from the digital display means, that the monitored signal has been present for a preselected interval of time whereby an indication is provided that a specified maintenance function is necessary.

* * * * *